US009534377B2

(12) United States Patent
Lee

(10) Patent No.: US 9,534,377 B2
(45) Date of Patent: Jan. 3, 2017

(54) DECK PRESERVATION SYSTEM

(71) Applicant: Earl Lee, Canton, GA (US)

(72) Inventor: Earl Lee, Canton, GA (US)

( * ) Notice: Subject to any disclaimer, the term of this patent is extended or adjusted under 35 U.S.C. 154(b) by 0 days.

(21) Appl. No.: 14/871,990

(22) Filed: Sep. 30, 2015

(65) Prior Publication Data

US 2016/0244961 A1 Aug. 25, 2016

Related U.S. Application Data

(63) Continuation-in-part of application No. 13/194,913, filed on Jul. 30, 2011, now abandoned.

(51) Int. Cl.

| | |
|---|---|
| ***E04C 2/38*** | (2006.01) |
| ***E04B 1/64*** | (2006.01) |
| ***E04B 1/00*** | (2006.01) |
| ***E04C 3/12*** | (2006.01) |
| ***E04C 3/29*** | (2006.01) |
| *E04F 11/17* | (2006.01) |
| *B63B 3/48* | (2006.01) |
| *E04B 5/12* | (2006.01) |
| *B63B 5/06* | (2006.01) |
| *E04F 15/02* | (2006.01) |

(52) U.S. Cl.

CPC ..... *E04B 1/64* (2013.01); *E04B 1/003* (2013.01); *E04C 3/125* (2013.01); *E04C 3/29* (2013.01); *B63B 3/48* (2013.01); *B63B 5/06* (2013.01); *E04B 5/12* (2013.01); *E04F 11/17* (2013.01); *E04F 15/02183* (2013.01)

(58) Field of Classification Search

CPC ..... E04F 15/02172; E04F 2201/0517; E04F 11/17; E04F 15/02183; E04C 3/125; E04C 3/29; B63B 3/48; B63B 5/06; E04B 5/12

USPC ..... 52/835, 300, 177, 650.3, 511, 3, 836, 52/716.2

See application file for complete search history.

(56) References Cited

U.S. PATENT DOCUMENTS

| | | | | |
|---|---|---|---|---|
| 2,178,388 A * | 10/1939 | Beckman | A01D 61/00 52/514 |
| 3,271,919 A * | 9/1966 | Olton | E06B 3/88 52/717.01 |
| 3,353,867 A | 11/1967 | Anderson | |
| 3,416,282 A * | 12/1968 | Daugherty | A47B 95/04 428/122 |
| 3,722,473 A * | 3/1973 | Vickstrom | A01K 1/0151 119/529 |
| 4,078,759 A | 3/1978 | Lanier | |
| 4,094,546 A | 6/1978 | Glassmeyer et al. | |

(Continued)

*Primary Examiner* — Chi Q Nguyen

(74) *Attorney, Agent, or Firm* — Crose Law LLC; Bradley D. Crose

(57) ABSTRACT

A deck preservation system includes an elongated one-piece deck board cap top cover for a deck board, adapted for a secure coupling to a top surface of the deck board to cover the top surface; a first cap side, with at least one first fin, integrally formed with the top cover and extended downwardly and adapted for a secure coupling to a board side of the deck board; a second cap side, with at least one second fin, integrally formed with the top cover and extended downwardly and adapted for a secure coupling to a board side of the deck board; wherein the first cap side and the second cap side are opposed to one another; and an inverted channel profile integrally formed and defined by the deck board top cover and first and second cap sides to cover and protect the deck board.

18 Claims, 5 Drawing Sheets

(56) References Cited

U.S. PATENT DOCUMENTS 4,858,413 A * 8/1989 Grushka ..... A47B 95/043 108/27
4,885,882 A * 12/1989 Forshee ..... B63B 3/48 52/177
4,907,387 A 3/1990 Turnbull
5,070,664 A 12/1991 Groh et al.
5,326,187 A * 7/1994 St. Marie ..... E04F 11/1836 256/66
5,351,458 A * 10/1994 Lehe ..... E04B 5/10 119/529
5,368,360 A 11/1994 Groh
5,794,390 A 8/1998 Oliveri et al.
5,906,084 A 5/1999 Millington et al.
5,913,784 A * 6/1999 Hite ..... E01O 5/22 52/177
6,108,992 A * 8/2000 Shaw ..... E04B 1/70 52/177
6,128,880 A 10/2000 Meenan, Jr.
6,209,267 B1 4/2001 Dantzer
6,427,395 B1 8/2002 Elsasser et al.
6,490,838 B2 12/2002 Summerford
6,688,054 B2 * 2/2004 Pasterchick ..... E04F 15/02183 52/177
6,742,311 B2 6/2004 Fortier
7,007,437 B2 * 3/2006 Thomas ..... E04F 15/02183 52/510
7,441,378 B2 * 10/2008 Wood ..... E04F 15/02 52/177
7,503,146 B2 * 3/2009 Thomas ..... E04F 15/02183 52/177
7,571,576 B2 8/2009 Pruitt
7,673,425 B2 * 3/2010 Thomas ..... E04D 13/0445 52/177
7,716,888 B2 5/2010 Richards
7,730,693 B2 6/2010 Schrotenboer
7,908,812 B2 3/2011 Eberle, III
8,251,018 B2 * 8/2012 Mooney ..... A01K 1/0151 119/526
8,925,285 B2 * 1/2015 Brewerton ..... E02D 5/04 52/783.13
2013/0025238 A1 * 1/2013 Lee ..... E04C 3/125 52/835

* cited by examiner

DECK PRESERVATION SYSTEM

CROSS-REFERENCE TO RELATED APPLICATION(S)

The present non-provisional patent application is a Continuation-In-Part (CIP) application which claims the benefit of priority of U.S. patent application Ser. No. 13/194,913 which is entitled "DECK PRESERVATION SYSTEM", which was filed on Jul. 30, 2011, and which is incorporated in full by reference herein.

FIELD OF THE INVENTION

The technology described herein relates generally to the fields of decks, decking systems, and deck preservation. More specifically, this technology relates to a deck preservation system and retrofit decking system to cover the existing structural elements of a deck such as deck boards, top rails, board ends, steps, and the like.

BACKGROUND OF THE INVENTION

Decks, decking systems, and the like are known in the background art. By way of example, wooden decks can be utilized to extend the living area of a home, surround a pool, as part of landscaping, as patio alternatives, and so forth. Wooden decks can be made of pine, cedar, and other softwoods and hardwoods. Wooden decks require a significant amount of time and expense in regular and repeated maintenance to slow the effects of deterioration. Even with regular maintenance, wooden decks can still deteriorate.

Wooden decking products are known to deteriorate over time. Particularly in an outdoor environment, wooden decking products can deteriorate rapidly. Deterioration can occur due to precipitation, sun, wind, prolonged use, and the like. Deterioration can include splintering wood, dry wood, rot, decomposition, discolored wood, and so forth.

Attempts to halt or slow the process of deterioration include regular and repeated sealing and staining of the wood boards of the deck, a laborious task. Other alternatives include utilizing treated lumber such as pressure treated woods; however, such woods are known to include chemicals such as chromate copper arsenate and may include toxic materials such as strychnine.

Other attempts to halt or slow the process of deterioration include the use of non-wood or partial wood decks. By way of example, composite systems, or artificial decking systems, which tend to be very expensive, are known in which recycled products are used with some wood products to produce a wood-like plank of wood-plastic composites. Recycled materials used may include high-density polyethylene (HDPE), polystyrene (PS) and PET plastic as well as mixed plastics. However composite decking systems may contain harmful chemicals. Additionally, composite decking systems cannot be refurbished. Furthermore, composite decking systems can still attract mold. Still furthermore, composite decking systems are still susceptible to expanding when hot, contracting when cold, and cracking. Still other deck alternatives include using aluminum, which is expensive and cumbersome.

Related patents known in the art include the following: U.S. Pat. No. 4,078,759, issued to Lanier on Mar. 14, 1978, discloses a portable decking system. U.S. Pat. No. 4,094,546, issued to Glassmeyer et al. on Jun. 13, 1978, discloses a roll away decking system. U.S. Pat. No. 5,906,084, issued to Millington et al. on May 25, 1999, discloses a modular decking system. U.S. Pat. No. 6,128,880, issued to Meenan, Jr. on Oct. 10, 2000, discloses a removable modular decking system. U.S. Pat. No. 6,209,267, issued to Dantzer on Apr. 3, 2001, discloses a decking system. U.S. Pat. No. 6,490,838, issued to Summerford on Dec. 10, 2002, discloses an above-grade decking system. U.S. Pat. No. 6,742,311, issued to Fortier on Jun. 1, 2004, discloses a modular transportable floor decking system. U.S. Pat. No. 7,571,576, issued to Pruitt on Aug. 11, 2009, discloses a decking system. U.S. Pat. No. 7,716,888, issued to Richards on May 18, 2010, discloses a composite decking system. U.S. Pat. No. 7,730,693, issued to Schrotenboer on Jun. 8, 2010, discloses a decking system. U.S. Pat. No. 7,908,812, issued to Eberle, III on Mar. 22, 2011, discloses a decking system and anchoring device. U.S. Pat. No. 6,128,880, issued to Groh et al. on Dec. 10, 1991, discloses a thermoplastic cover for stadium seating, picnic tables, boat docks, and the like. U.S. Pat. No. 5,794,390, issued to Oliveri et al. on Aug. 18, 1998, discloses a structural covering. U.S. Pat. No. 4,907,387, issued to Turnbull on Mar. 13, 1990, discloses a patio deck sheath. U.S. Pat. No. 5,368,360, issued to Groh on Nov. 29, 1994, discloses a cover piece for a seat member of a bleacher seat unit. U.S. Pat. No. 6,427,395, issued to Elsasser et al. on Aug. 6, 2002, discloses an elongated covering member of extruded plastic suitable for flooring, decking, seating, and like uses. U.S. Pat. No. 3,353,867, issued to Anderson on Nov. 21, 1967, discloses a bench and plank cover.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides a deck preservation system and retrofit decking system to cover the existing structural elements of a deck such as deck boards, top rails, board ends, steps, and the like.

In one exemplary embodiment, the technology described herein provides a deck board cap. The deck board cap includes: an elongated one-piece deck board cap top cover for a deck board, adapted for a secure coupling to a board top surface of the deck board to cover the board top surface; a first cap side integrally formed with the deck board top cover and extended downwardly and adapted for a secure coupling to a board side of the deck board; a second cap side integrally formed with the deck board cap top cover and extended downwardly and adapted for a secure coupling to a board side of the deck board; wherein the first cap side and the second cap side are opposed to one another; and an inverted channel profile integrally formed and defined by the deck board top cover and first and second cap sides to cover and protect the deck board; at least one first fin extended from a midsection of at least one of the first cap side and at least one second fin extended from a midsection of the second cap side, wherein the at least one fin and the at least one second fin are extended inwardly toward the inverted channel profile; and a curvature defined and integrally formed within the elongated one-piece deck board cap top cover, wherein the curvature is very slight and upward and adapted for water runoff such that precipitation does not pool, wherein the curvature defined in the deck board cap top cover is adapted to provide a tension to cling to the deck board.

In at least one embodiment, the deck board cap also includes at least one flange extended from a base of at least one of the first cap side and the second cap side.

In at least one embodiment, the deck board cap further includes at least one flange extended from a base of at least one of the first cap side and the second cap side, wherein the at least one flange is extended inwardly toward the inverted channel profile.

In at least one embodiment, the deck board cap also includes at least one flange extended from a base of at least one of the first cap side and the second cap side, wherein the at least one flange is extended outwardly away from inverted channel profile.

In at least one embodiment, the deck board cap further includes at least one flange extended from at least one of the first cap side and the second cap side, wherein the at least one flange is extended both inwardly toward the inverted channel profile and outwardly away from inverted channel profile.

In at least one embodiment, the deck board cap also includes at least one fin extended from a midsection of at least one of the first cap side and the second cap side.

In at least one embodiment, the deck board cap further includes at least one fin extended from a midsection of at least one of the first cap side and the second cap side, wherein the at least one fin is extended inwardly toward the inverted channel profile.

In at least one embodiment, the deck board cap also includes at least one fin extended from a midsection of at least one of the first cap side and the second cap side, wherein the at least one fin is extended outwardly away from inverted channel profile.

In at least one embodiment, the deck board cap further includes: at least one fin extended from a midsection of at least one of the first cap side and the second cap side, wherein the at least one fin is extended inwardly toward the inverted channel profile; and at least one fin extended from a midsection of at least one of the first cap side and the second cap side, wherein the at least one fin is extended outwardly away from inverted channel profile.

In at least one embodiment, the deck board cap also includes a curvature defined and integrally formed within the elongated one-piece deck board cap top cover, wherein the curvature is very slight and upward and adapted for water runoff such that precipitation does not pool.

In at least one embodiment, the deck board cap further includes: a curvature defined and integrally formed within the elongated one-piece deck board cap top cover, wherein the curvature is very slight and upward and adapted for water runoff such that precipitation does not pool; and a second curvature defined in each of the first cap side and the second cap side as each extends downwardly from the deck board cap top cover; wherein the curvature defined in the deck board cap top cover and the second curvature defined in each of the first cap side and the second cap side are adapted to provide a tension to cling to the deck board.

In at least one embodiment, the first cap side and the second side cap extended downwardly from the deck board top cover at a less than ninety-degree angle and inwardly relative to the deck board top cover, thus configured to more substantially grip the board side of the deck board.

In another exemplary embodiment, the technology described herein provides a deck preservation system. The deck preservation system includes: at least one deck board cap having: an elongated one-piece deck board cap top cover for a deck board, adapted for a secure coupling to a board top surface of the deck board to cover the board top surface; a first cap side integrally formed with the deck board top cover and extended downwardly and adapted for a secure coupling to a board side of the deck board; a second cap side integrally formed with the deck board cap top cover and extended downwardly and adapted for a secure coupling to a board side of the deck board; wherein the first cap side and the second cap side are opposed to one another; and an inverted channel profile integrally formed and defined by the deck board top cover and first and second cap sides to cover and protect the deck board; at least one first fin extended from a midsection of at least one of the first cap side and at least one second fin extended from a midsection of the second cap side, wherein the at least one fin and the at least one second fin are extended inwardly toward the inverted channel profile; and a curvature defined and integrally formed within the elongated one-piece deck board cap top cover, wherein the curvature is very slight and upward and adapted for water runoff such that precipitation does not pool, wherein the curvature defined in the deck board cap top cover is adapted to provide a tension to cling to the deck board; and at least one end cap configured to cover an end of the deck board and to protect and preserve the end of the deck board.

In at least one embodiment, the deck preservation system also includes at least one rail cap configured to cover a deck rail board and to protect and preserve the deck rail board of the deck.

In at least one embodiment, the deck preservation system further includes at least step cap configured to cover a step board and to protect and preserve the step board of the deck.

In at least one embodiment, the deck preservation system also includes at least one edge and trim cap configured to cover a board edge and to protect and preserve the board edge of the deck. In at least one embodiment, the at least one edge and trim cap is "L" shaped. In at least one embodiment, the at least one edge and trim cap is "T" shaped.

In yet another exemplary embodiment, the technology described herein provides a wooden deck board cap. The wooden deck board cap includes: an elongated one-piece deck board cap top cover for a wooden deck board, adapted for a secure coupling to a board top surface of the wooden deck board to cover the board top surface; a first cap side integrally formed with the deck board top cover and extended downwardly and adapted for a secure coupling to a board side of the wooden deck board; a second cap side integrally formed with the deck board cap top cover and extended downwardly and adapted for a secure coupling to a board side of the wooden deck board; wherein the first cap side and the second cap side are opposed to one another; an inverted channel profile integrally formed and defined by the deck board top cover and first and second cap sides to cover and protect the wooden deck board; and at least one fin extended from a midsection of at least one of the first cap side and the second cap side.

In at least one embodiment, the at least one fin of the wooden deck board cap is extended inwardly toward the inverted channel profile.

In at least one embodiment, the wooden deck board cap also includes a curvature defined and integrally formed within the elongated one-piece deck board cap top cover, wherein the curvature is very slight and upward and adapted for water runoff such that precipitation does not pool.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a deck preservation system and retrofit decking system to cover the existing structural elements of a deck such as deck boards, top rails, board ends, steps, and the like.

The board caps depicted are not to be structural weight bearing elements, but rather are caps to preserve decks and extend the period of use of decks. The board caps are very lightweight and therefore make more useful caps and provide preservation, but they are not to be utilized for structural weight bearing needs.

Figure 1:
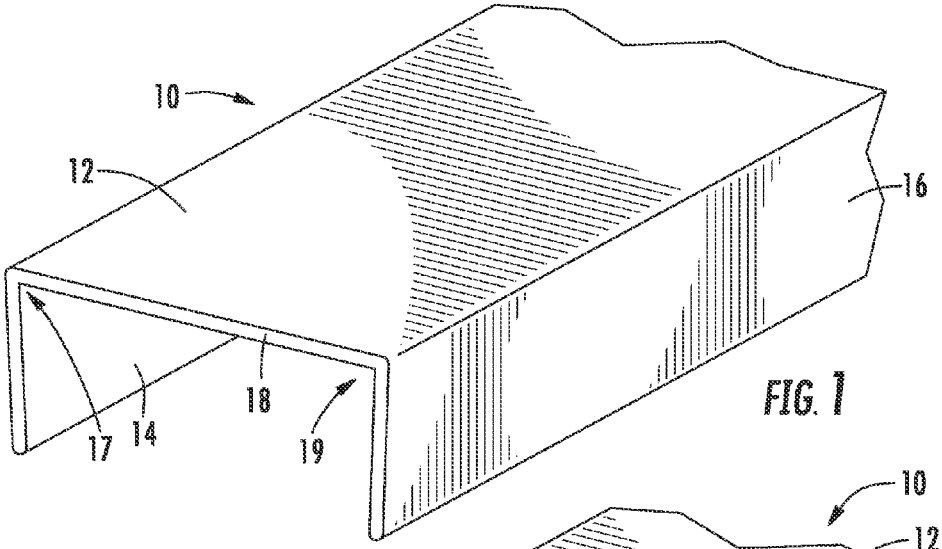
FIG. 1 is a front perspective view of a deck board cap, according to an embodiment of the invention.

Referring now to FIG. 1, a front perspective view of a deck board cap 10 is shown. The deck board cap 10 is elongated and designed as a one-piece cap for a deck board or plank. By way of example, the deck board cap 10 can be manufactured from vinyl, plastic, thermoplastic, PVC, or like material. As such the deck board cap 10 provides protection to the underlying board. In at least one embodiment, the deck board cap 10 covers a single board. In at least one embodiment, the deck board cap 10 covers multiple boards.

The deck board cap 10 includes a top cover 12 portion. The top portion 12 of the deck board cap 10 is adapted for a secure placement over a board top surface of the deck board to cover the board top surface.

The deck board cap 10 includes a first cap side 14 integrally formed with the deck board top cover 12 and extended downwardly and adapted for a secure coupling to a board side of the deck board.

The deck board cap 10 includes a second cap side 16 integrally formed with the deck board cap top cover 12 and extended downwardly and adapted for a secure coupling to a board side of the deck board.

The first cap side 14 and the second cap side 16 extend downwardly from the deck board cap top cover 12. The first cap side 14 and the second cap 16 side are opposed to one another.

Figure 2:
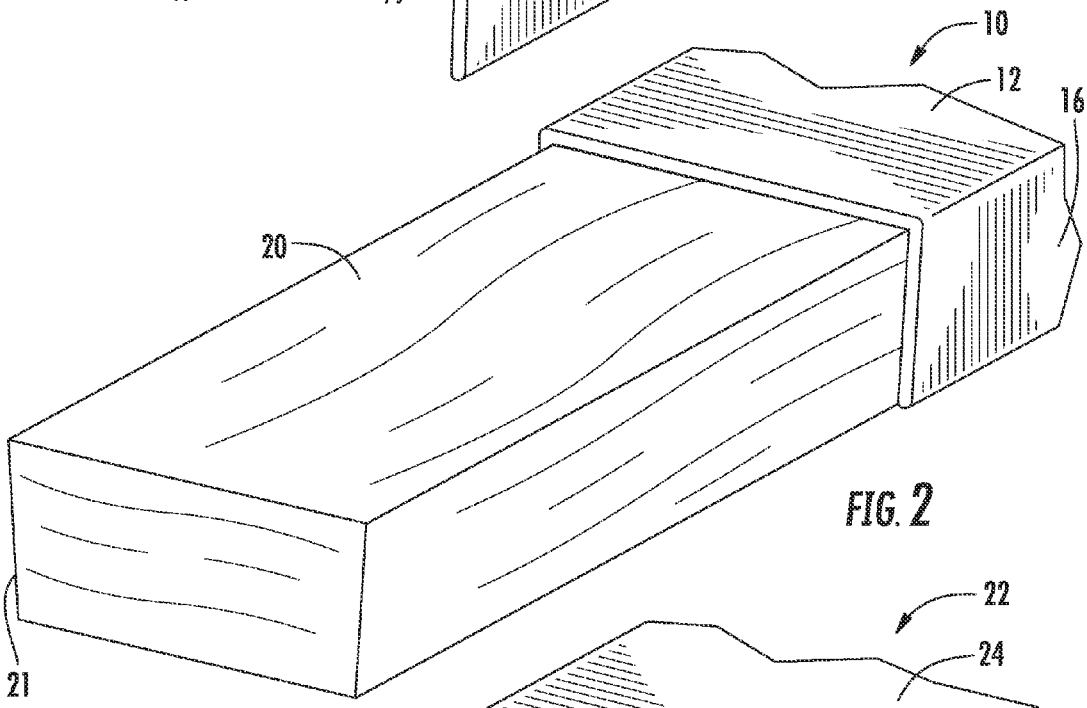
FIG. 2 is a front perspective view of a deck board cap depicted in FIG. 1, illustrating, in particular, secure application upon a deck board, according to an embodiment of the invention.
Figure 7:
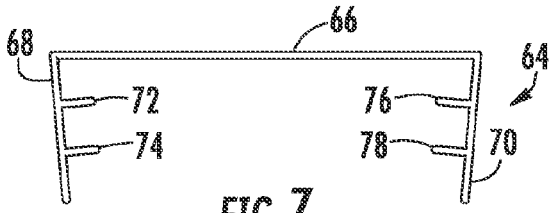
FIG. 7 is an end view of a board cap, illustrating, in particular, multiple inward facing fins disposed upon the sides of the board cap, according to an embodiment of the invention.

In at least one embodiment, the first cap side 14 and the second side cap 16 extended downwardly from the deck board top cover 12 at a less-than-ninety-degree angle and inwardly facing relative to the deck board top cover 12, thus configured to more substantially grip the board side of the deck board. By way of example, and as shown in FIG. 1, first cap side 14 is related to deck board top cover 12 by angle 17, and second side cap 16 is related to deck board top cover 12 by angle 19. Angle 17 and angle 19 can vary by application and manufacture, but by way of example can be one to two degrees short of a ninety-degree angle, this inwardly angled to better grip a deck board securely. As is depicted in FIG. 2, the board itself upon which a deck board cap 10 is placed, can be pre-cut, such as with tapered edge 21, to better accommodate the deck board cap depicted in FIG. 1. Also, by way of example, the embodiment of FIG. 7 is shown with inwardly angled and facing sides.

The deck board cap top cover 12 and the first and second cap sides 14, 16 can be manufactured of a desired thickness 18 to provide adequate protection and cover to the underlying deck board. In at least one embodiment, the deck board cap top cover 12 and the first and second cap sides 14, 16 are manufactured of the same thickness. In at least one alternative embodiment, the deck board cap top cover 12 and the first and second cap sides 14, 16 are manufactured such that the first and second cap sides 14, 16 are of a different thickness, such as thinner, for example, than the deck board cap top cover 12.

An inverted channel profile is integrally formed and defined by the deck board top cover 12 and first and second cap sides 14, 16 to cover and protect the deck board.

Referring now to FIG. 2, a front perspective view of a deck board cap 10 is shown. The deck board cap 10 is shown in secured application upon a deck board 20. The deck board cap 10 is placed over the deck board and pushed downwardly to cover the board. The top surface of the deck board 20 is covered by the deck board cap top cover 12. Typically when original decks are installed, a space, such as the width of a large nail, is left between adjacent deck boards. The space provides an area to receive the first and second cap sides 14, 16. The space can be altered as required to provide for the insertion of the first and second cap sides 14, 16.

Figure 3:
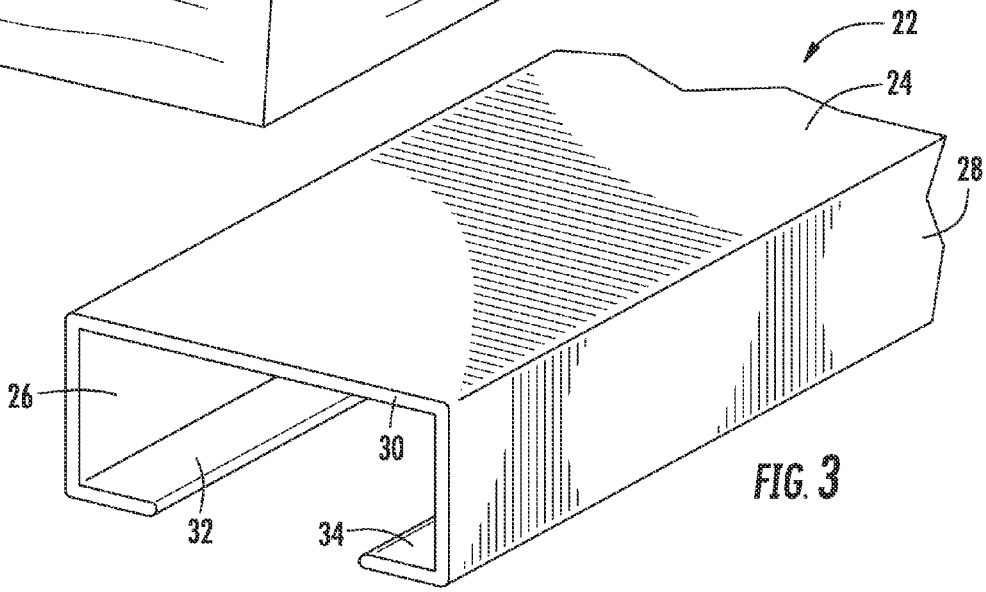
FIG. 3 is a front perspective view of a top rail cap, according to an embodiment of the invention.

Referring now to FIG. 3, a front perspective view of a top rail cap 22. The top rail cap 22 is configured to place over a deck rail, or other like deck component. The top rail cap includes a top cover portion 24 to cover the top surface of the rail.

The top rail cap 22 includes a first rail side 26 integrally formed with the top rail cap 22 and extended downwardly and adapted for a secure coupling to a deck rail. The first rail side 26 shown includes flange 32 to secure the top rail cap 22 to the rail from the underside.

The top rail cap 22 includes a second rail side 28 integrally formed with top rail cap 22 and extended downwardly and adapted for a secure coupling to a deck rail. The second rail side 28 shown includes flange 34 to secure the top rail cap 22 to the rail from the underside.

The top rail cap 22 and the first and second rail sides 26, 28 can be manufactured of a desired thickness 30 to provide adequate protection and cover to the underlying deck board.

Figure 4:
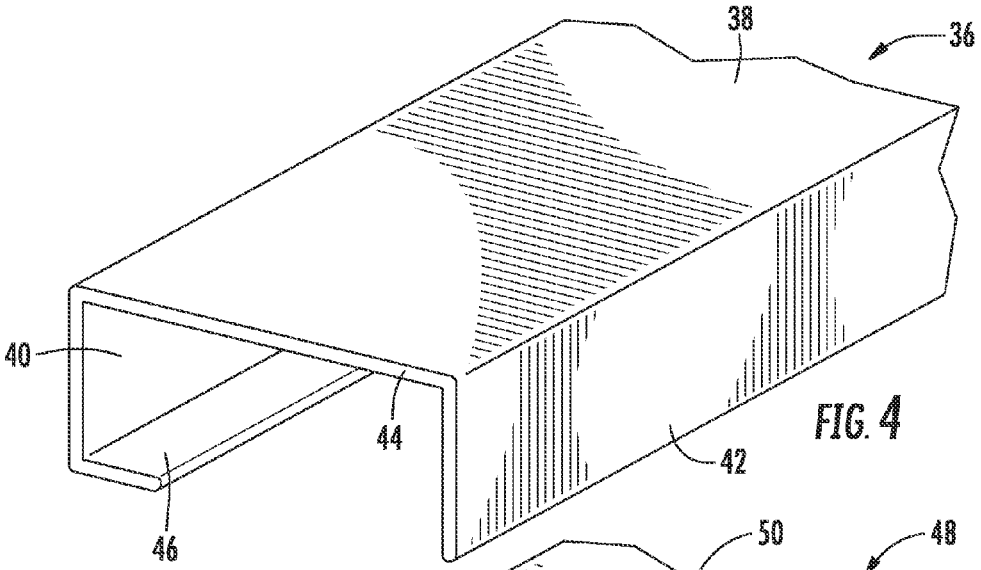
FIG. 4 is a front perspective view of a step cap, according to an embodiment of the invention.

Referring now to FIG. 4, a front perspective view of a step cap 36 is shown. Deck systems are known to sometimes include steps. The step cap 36 is configured to place over a deck step, or other like deck component. The step cap 36 includes a top step cover portion 38 to cover the top surface of the step.

The step cap 36 includes a first step cap side 40 integrally formed with the step cap 36 and extended downwardly and adapted for a secure coupling to a deck step. The first step cap side 40 shown includes flange 46 to secure the step cap 36 to the step from the underside.

The step cap 36 includes a second step cap side 42 integrally formed with the step cap 36 and extended downwardly and adapted for a secure coupling to a deck step. The second step cap side 42 shown does not include a flange.

The step cap 36 and the first and second step cap sides 40, 42 can be manufactured of a desired thickness 44 to provide adequate protection and cover to the underlying deck board.

Figure 5:
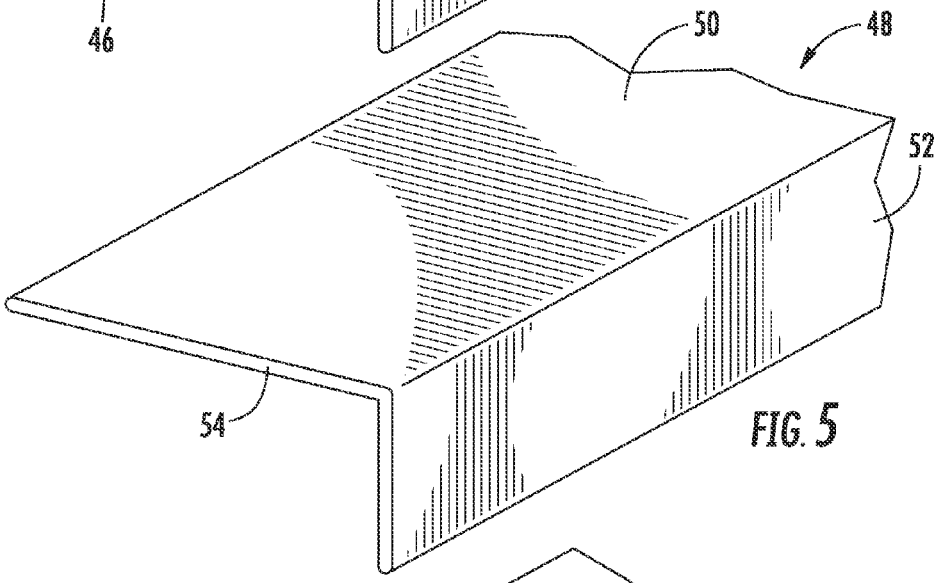
FIG. 5 is a front perspective view of an edge and trim cap, according to an embodiment of the invention.

Referring now to FIG. 5, a front perspective view of an edge and trim cap 48 is shown. The edge and trim cap 48 is utilized to cover and protect various edges of an existing deck system that are otherwise uncovered by another component of this deck preservation system.

The edge and trim cap 48 includes a top portion 50, a side 52 extending downwardly from the top portion 50 and integrally formed with the top portion 50. The edge and trim cap 48, top portion 50, and side 52 can be manufactured of a desired thickness 54 to provide adequate protection and cover to the underlying deck board.

Figure 6:
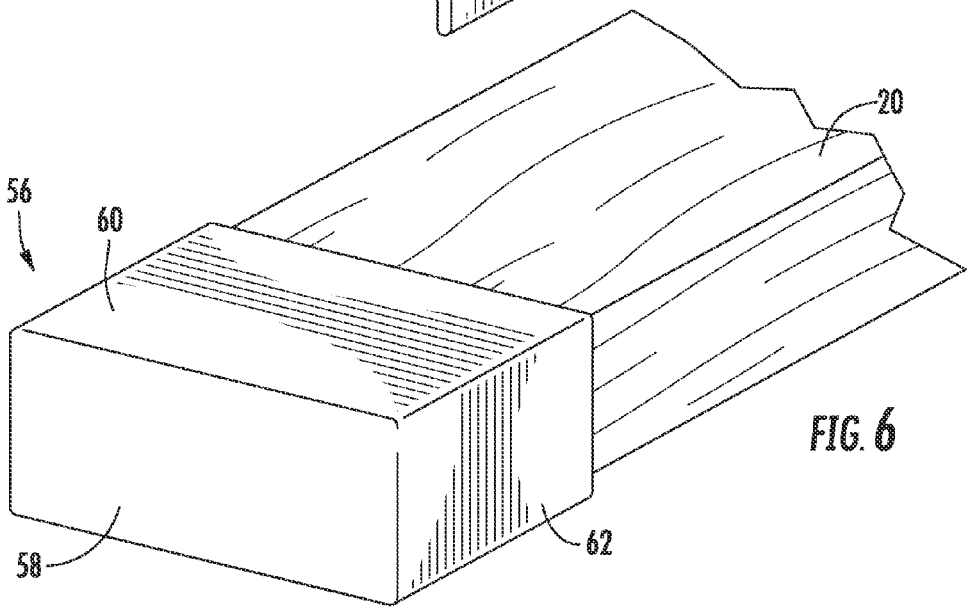
FIG. 6 is a front perspective view of an end cap, according to an embodiment of the invention.

Referring now to FIG. 6, a front perspective view of an end cap 56 is shown. The end cap 56 covers the end of a deck board that is not otherwise covered by another element of this deck preservation system.

The end cap 56 is generally cubed, having 5 of six sides with one open to cover an end of a deck board 20. As depicted, three sides: a top 60, side 62, and end 58 are shown.

Figure 7A:
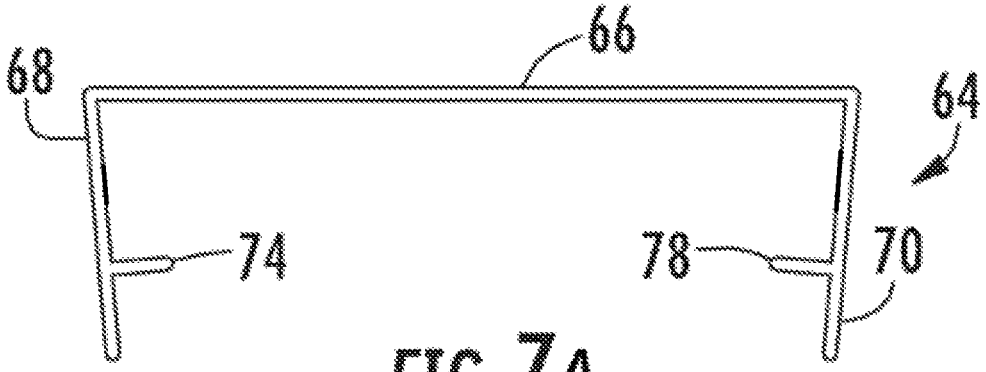
FIG. 7A is an end view of a board cap, illustrating, in particular, inward facing fins disposed upon the sides of the board cap, according to an embodiment of the invention.
Figure 7B:
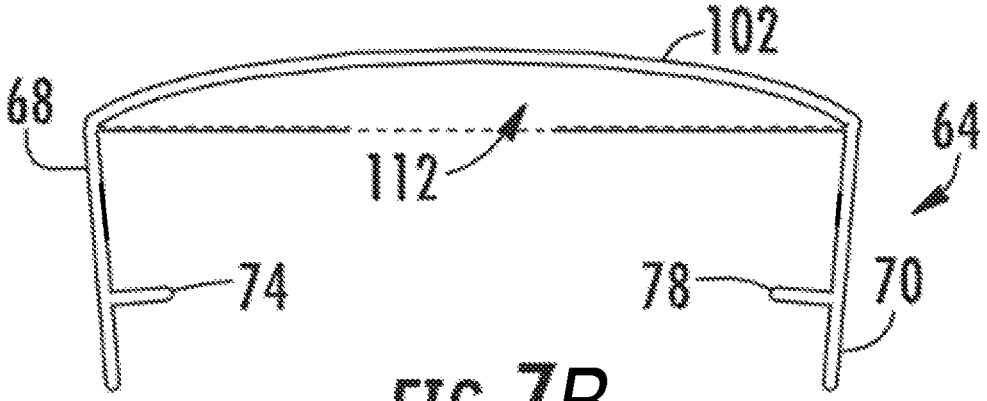
FIG. 7B is an end view of a board cap, illustrating, in particular, a slight upwardly curved top and inward facing fins disposed upon the sides of the board cap, according to an embodiment of the invention.

Referring now to FIGS. 7, 7A, and 7B, an end view of a board cap 64 is shown. This board cap 64 includes top 66 integrally formed with sides 68 and 70. This board cap 64 embodiment further includes multiple inwardly facing fins 72, 74, 76, 78 disposed upon the sides 68, 70 of the board cap 64. The multiple inwardly facing fins 72, 74, 76, 78 provide greater tension and attachment to a deck board. This embodiment can include one or more fins on each interior side. Additionally, this includes a curvature 102 defined and integrally formed within the elongated one-piece deck board cap top cover, wherein the curvature is very slight and upward and adapted for water runoff such that precipitation does not pool, wherein the curvature defined in the deck board cap top cover is adapted to provide a tension to cling to the deck board. As the board cap 64 is installed, the curvature is reduced as the pressure is downwardly placed for insertion. Combined with the fins 74, 78, the curvature 102 in the top board provides adequate friction to hold the board cap 64 in place without the need for additional mounting hardware. The curvature 102 shown is not to scale, but is shown larger than scale for ease in viewing. This described friction and tension are unique for this deck board cap 64 are provide a capability for installation not known with existing products.

Figure 8:
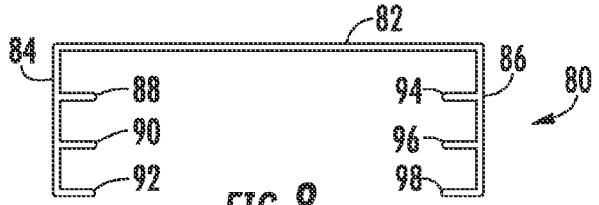
FIG. 8 is an end view of a board cap, illustrating, in particular, multiple inward facing fins and flanges disposed upon the sides of the board cap according to an embodiment of the invention.

Referring now to FIG. 8, an end view of another board cap 80 embodiment is shown. This board cap 80 includes top 82 integrally formed with sides 84 and 86. This board cap 80 embodiment further includes multiple inwardly facing fins 88, 90, 94, 96 disposed upon the sides 84, 86 of the board cap 80. The multiple inwardly facing fins 88, 90, 94, 96 provide greater tension and attachment to a deck board. Additionally, this board cap 80 includes flanges 92 and 98 disposed upon the bases of sides 84, 86 respectively.

Figure 9:
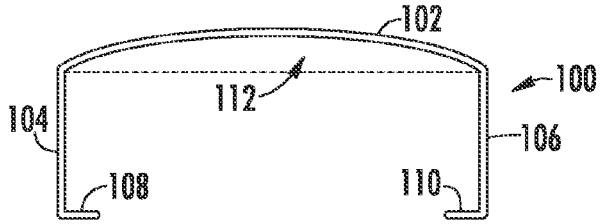
FIG. 9 is an end view of a board cap, illustrating, in particular, a slight upwardly curved top, according to an embodiment of the invention.

Referring now to FIG. 9, an end view of another board cap 100 embodiment is shown. This board cap 100 includes top 102 integrally formed with sides 104 and 106. Sides 104, 106 also include flanges 108, 110. In this embodiment, top 102 has a curvature 112 defined and integrally formed within the elongated one-piece deck board cap top cover. The curvature 112 is very slight and upward and adapted for water runoff such that precipitation does not pool.

Figure 10:
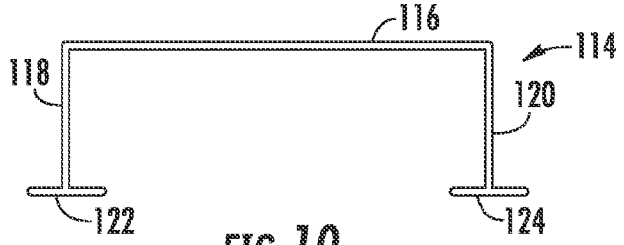
FIG. 10 is an end view of a board cap, illustrating, in particular, flanges projecting in multiple directions from each leg, according to an embodiment of the invention.

Referring now to FIG. 10, an end view of another board cap 114 embodiment is shown. This board cap 114 includes top 116 integrally formed with sides 118 and 120. Sides 118 and 120 each include flanges 122, 124. Flanges 122, 124 extend both inwardly toward the inverted channel profile and outwardly away from inverted channel profile.

Figure 11:
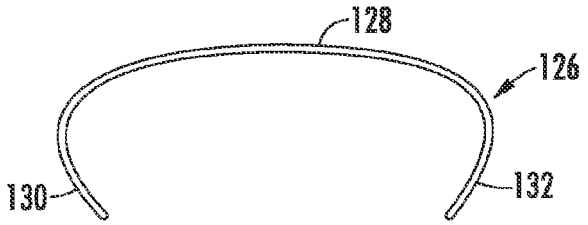
FIG. 11 is an end view of a board cap, illustrating, in particular, an inherent tension and curvature, according to an embodiment of the invention.

Referring now to FIG. 11, an end view of another board cap 126 embodiment is shown. This board cap 126 includes top 128 integrally formed with sides 130 and 132. In this embodiment, the sides 130, 132 are not generally at right angles to the top 128. The integrally formed top 128 and sides 130, 132, have a curvature and are adapted to provide a tension to cling to the deck board.

Figure 12:
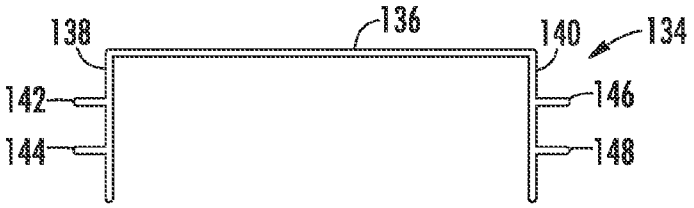
FIG. 12 is an end view of a board cap, illustrating, in particular, multiple outwardly facing fins, according to an embodiment of the invention.

Referring now to FIG. 12, an end view of another board cap 134 embodiment is shown. This board cap 134 includes top 136 integrally formed with sides 138 and 140. In this embodiment, the sides 138, 140 include fins 142, 144, 146, 148. In this embodiment of board cap 134, the fins 142, 144, 146, 148 extended outwardly away from inverted channel profile.

It will be apparent to one of ordinary skill on the art, upon reading this disclosure, that the board cap embodiments depicted in FIGS. 7 through 12 can vary in some aspects such as the number, combination, and location of flanges and fins.

Figure 13:
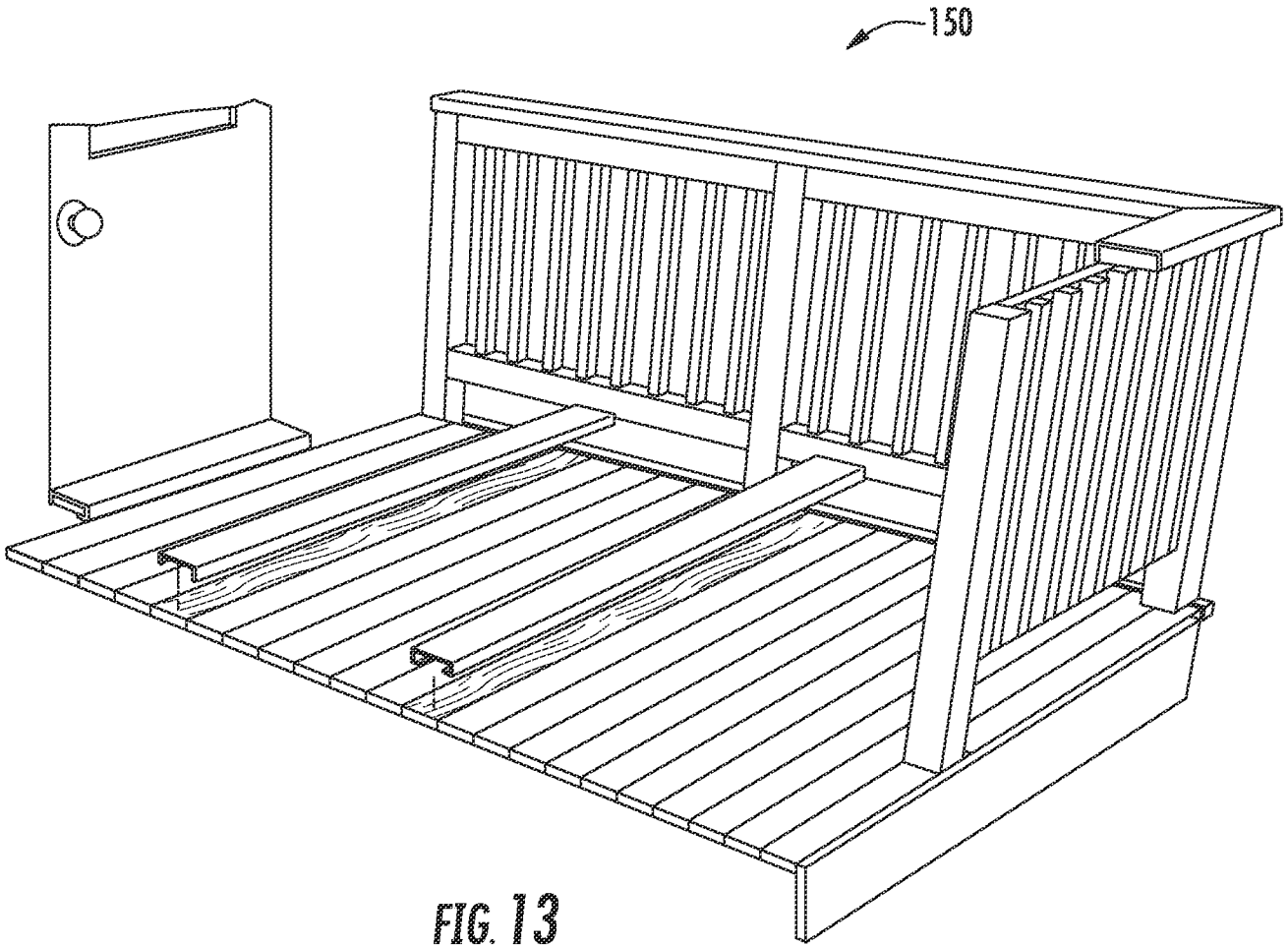
FIG. 13 is a front perspective view of a decking system utilizing deck board caps, rail caps, step caps, and edge and trim caps, according to an embodiment of the invention.

Referring now to FIG. 13, a deck preservation system 150 is shown implemented over an existing wooden deck.

The various deck board caps depicted throughout the disclosure can also include friction, non-slip portions, to provide stability to one walking across a floor board deck cap, for example. Additionally, the various deck board caps depicted throughout the disclosure can further include indentions, textures, and so forth, such as a wood grain look, or the like.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A deck board cap comprising:

an elongated one-piece deck board cap top cover for a deck board, adapted for a secure coupling to a board top surface of the deck board to cover the board top surface;

a first cap side integrally formed with the deck board top cover and extended downwardly and adapted for a secure coupling to a board side of the deck board and configured to substantially grip the board side of the deck board;

a second cap side integrally formed with the deck board cap top cover and extended downwardly and adapted for a secure coupling to a board side of the deck board and configured to substantially grip the board side of the deck board;

wherein the first cap side and the second cap side are opposed to one another;

an inverted channel profile integrally formed and defined by the deck board top cover and first and second cap sides to cover and protect the deck board;

at least one first fin extended from a midsection of at least one of the first cap side and at least one second fin extended from a midsection of the second cap side, wherein the at least one first fin and the at least one second fin are extended inwardly toward the inverted channel profile and are configured to provide greater tension and attachment to a deck board and to provide adequate friction between the fins and board surfaces to hold the deck board cap in place without the need for additional mounting hardware; and a curvature defined and integrally formed within the elongated one-piece deck board cap top cover, wherein the curvature is very slight and upward and adapted for water runoff such that precipitation does not pool, wherein the curvature defined in the deck board cap top cover is adapted to provide a tension to cling to the deck board;

wherein the first cap side and the second cap side extended straightly and downwardly from the deck board top cover at a predetermined, less than ninety-degree, angle, and inwardly relative to the deck board top cover, thus configured to more substantially grip the board side of the deck board;

wherein the deck board cap is adapted for placement over the deck board and for installation by a push downwardly to cover the deck board without the need for additional mounting hardware.

2. The deck board cap of claim 1, further comprising:

at least one flange extended from a base of at least one of the first cap side and the second cap side.

3. The deck board cap of claim 1, further comprising:

at least one flange extended from a base of at least one of the first cap side and the second cap side, wherein the at least one flange is extended inwardly toward the inverted channel profile.

4. The deck board cap of claim 1, further comprising:

at least one flange extended from a base of at least one of the first cap side and the second cap side, wherein the at least one flange is extended outwardly away from inverted channel profile.

5. The deck board cap of claim 1, further comprising:

at least one flange extended from at least one of the first cap side and the second cap side, wherein the at least one flange is extended both inwardly toward the inverted channel profile and outwardly away from inverted channel profile.

6. The deck board cap of claim 1, further comprising:

at least one fin extended from a midsection of at least one of the first cap side and the second cap side.

7. The deck board cap of claim 1, further comprising:

at least one fin extended from a midsection of at least one of the first cap side and the second cap side, wherein the at least one fin is extended outwardly away from inverted channel profile.

8. The deck board cap of claim 1, further comprising:

at least one fin extended from a midsection of at least one of the first cap side and the second cap side, wherein the at least one fin is extended inwardly toward the inverted channel profile; and at least one fin extended from a midsection of at least one of the first cap side and the second cap side, wherein the at least one fin is extended outwardly away from inverted channel profile.

9. The deck board cap of claim 1, further comprising:

a curvature defined and integrally formed within the elongated one-piece deck board cap top cover, wherein the curvature is very slight and upward and adapted for water runoff such that precipitation does not pool; and a second curvature defined in each of the first cap side and the second cap side as each extends downwardly from the deck board cap top cover;

wherein the curvature defined in the deck board cap top cover and the second curvature defined in each of the first cap side and the second cap side are adapted to provide a tension to cling to the deck board.

10. The deck board cap of claim 1, wherein the first cap side and the second side cap extended downwardly from the deck board top cover at a less than ninety-degree angle and inwardly relative to the deck board top cover, thus configured to more substantially grip the board side of the deck board.

11. A deck preservation system comprising:

at least one deck board cap having: an elongated one-piece deck board cap top cover for a deck board, adapted for a secure coupling to a board top surface of the deck board to cover the board top surface; a first cap side integrally formed with the deck board top cover and extended downwardly and adapted for a secure coupling to a board side of the deck board and configured to substantially grip the board side of the deck board; a second cap side integrally formed with the deck board cap top cover and extended downwardly and adapted for a secure coupling to a board side of the deck board and configured to substantially grip the board side of the deck board; wherein the first cap side and the second cap side are opposed to one another; and an inverted channel profile integrally formed and defined by the deck board top cover and first and second cap sides to cover and protect the deck board; at least one first fin extended from a midsection of at least one of the first cap side and at least one second fin extended from a midsection of the second cap side, wherein the at least one first fin is extended inwardly toward the inverted channel profile and are configured to provide greater tension and attachment to a deck board and to provide adequate friction between the fins and board surfaces to hold the deck board cap in place without the need for additional mounting hardware; and a curvature defined and integrally formed within the elongated one-piece deck board cap top cover, wherein the curvature is very slight and upward and adapted for water runoff such that precipitation does not pool, wherein the curvature defined in the deck board cap top cover is adapted to provide a tension to cling to the deck board; and at least one end cap configured to cover an end of the deck board and to protect and preserve the end of the deck board;

wherein the first cap side and the second cap side extended straightly and downwardly from the deck board top cover at a predetermined, less than ninety-degree, angle, and inwardly relative to the deck board top cover, thus configured to more substantially grip the board side of the deck board;

wherein the deck board cap is adapted for placement over the deck board and for installation by a push downwardly to cover the deck board without the need for additional mounting hardware.

12. The deck preservation system of claim 11, further comprising:

at least one rail cap configured to cover a deck rail board and to protect and preserve the deck rail board of the deck.

13. The deck preservation system of claim 11, further comprising:

at least step cap configured to cover a step board and to protect and preserve the step board of the deck.

14. The deck preservation system of claim 11, further comprising:

at least one edge and trim cap configured to cover a board edge and to protect and preserve the board edge of the deck.

15. The deck preservation system of claim 14, wherein the at least one edge and trim cap is one of "L" shaped and "T" shaped.

16. A wooden deck board cap comprising:

an elongated one-piece deck board cap top cover for a wooden deck board, adapted for a secure coupling to a board top surface of the wooden deck board to cover the board top surface;

a first cap side integrally formed with the deck board top cover and extended downwardly and adapted for a secure coupling to a board side of the wooden deck board and configured to substantially grip the board side of the deck board;

a second cap side integrally formed with the deck board cap top cover and extended downwardly and adapted for a secure coupling to a board side of the wooden deck board and configured to substantially grip the board side of the deck board;

wherein the first cap side and the second cap side are opposed to one another;

an inverted channel profile integrally formed and defined by the deck board top cover and first and second cap sides to cover and protect the wooden deck board; and at least one fin extended from a midsection of at least one of the first cap side and the second cap side, wherein the at least one fin is configured to provide greater tension and attachment to a deck board and to provide adequate friction between the fin and board surface to hold the deck board cap in place without the need for additional mounting hardware;

wherein the first cap side and the second cap side extended straightly and downwardly from the deck board top cover at a predetermined, less than ninety-degree, angle, and inwardly relative to the deck board top cover, thus configured to more substantially grip the board side of the deck board;

wherein the deck board cap is adapted for placement over the deck board and for installation by a push downwardly to cover the deck board without the need for additional mounting hardware.

17. The wooden deck board cap of claim 16, wherein the at least one fin is extended inwardly toward the inverted channel profile.

18. The wooden deck board cap of claim 16, further comprising:

a curvature defined and integrally formed within the elongated one-piece deck board cap top cover, wherein the curvature is very slight and upward and adapted for water runoff such that precipitation does not pool.

* * * * *